US005787615A

United States Patent [19]

Hensel et al.

[11] Patent Number: 5,787,615

[45] Date of Patent: Aug. 4, 1998

[54] SPRAY AND STEAM PUMP FOR A STEAM IRON

[75] Inventors: Keith J. Hensel, North Sydney; Richard L. Hoare, Neutral Bay, both of Australia

[73] Assignee: Sunbeam Products, Inc., Ft. Lauderdale, Fla.

[21] Appl. No.: 555,701

[22] Filed: Nov. 14, 1995

[51] Int. Cl.[6] ..... D06F 75/18; D06F 75/22

[52] U.S. Cl. ..... 38/77.5

[58] Field of Search ..... 38/77.1, 77.5, 38/77.8, 77.83; 222/330, 340, 341; 417/531, 539, 515, 529, 536, 554; 137/565, 329.3; 251/359

[56] References Cited

U.S. PATENT DOCUMENTS

| | | | |
|---|---|---|---|
| 1,896,445 | 2/1933 | Gibson | 417/529 X |
| 3,373,516 | 3/1968 | Knapp et al. | 38/77.5 |
| 3,881,265 | 5/1975 | Eaton et al. | 38/77.5 |
| 4,104,815 | 8/1978 | Hammer et al. | 38/77.5 |
| 4,197,664 | 4/1980 | Hammer et al. | 38/77.83 |
| 4,398,364 | 8/1983 | Augustine et al. | 38/77.5 |
| 4,910,895 | 3/1990 | Rethmeier et al. | 38/77.83 |
| 5,038,501 | 8/1991 | Hipp et al. | 38/77.5 |
| 5,136,796 | 8/1992 | Farrington | 38/77.5 |
| 5,209,407 | 5/1993 | Farrington | 239/491 |
| 5,414,945 | 5/1995 | Freeman et al. | 38/96 |
| 5,421,110 | 6/1995 | Morrissey et al. | 38/77.82 |
| 5,446,983 | 9/1995 | Patrick | 38/77.7 |

FOREIGN PATENT DOCUMENTS

| | | | |
|---|---|---|---|
| 2442126 | 3/1975 | Germany | 38/77.5 |
| 2750267 | 11/1978 | Germany . | |
| 2904196 | 8/1980 | Germany . | |
| 258253 | 7/1988 | Germany | 38/77.5 |
| 150795 | 8/1985 | Japan | 38/77.5 |
| 1103500 | 5/1986 | Japan | 38/77.5 |

*Primary Examiner*—Ismael Izaguirre
*Attorney, Agent, or Firm*—Thorp Reed & Armstrong

[57] ABSTRACT

A steam iron pump assembly including two pistons for producing a spray of water and/or a surge of steam. The pump assembly includes a shared water inlet and a flange for directing a ball check valve to the valve seat during the assembly of the pump.

8 Claims, 9 Drawing Sheets

SPRAY AND STEAM PUMP FOR A STEAM IRON

BACKGROUND OF THE INVENTION

This invention relates to a steam iron, and particularly to a pump for a steam iron having two pumping operations, one for pumping water from a water reservoir to a nozzle in order to generate a spray of water directed to the fabric being ironed, and a second for pumping water into a steam-generating chamber in order to obtain a sudden and abundant discharge of steam or "steam surge".

Steam irons are, in general, comprised of a heated sole plate having a series of steam outlets in the bottom face and a steam-generating chamber proximate the sole plate top face which is in communication with the steam outlets and which also communicates with a tank of water via an adjustable low flow rate tap under the control of a rotary knob placed on the top portion of the iron.

Steam irons are also generally fitted with a pump suitable for taking a quantity of water from the tank and for delivering that water via a selector member either into the steam-generating chamber in order to obtain the steam surge or into a spray nozzle positioned at the front of the iron in order to produce the spray of water.

A prior art pump assembly is illustrated in FIG. 1. Although the prior art assembly performs well, it requires a slide switch and piston rod which allows a single pump button to switch back and forth between one of two pistons for performing either the water spray or steam surge functions. The slide switch and piston rod assembly require significant attention during assembly, and can consequently be expensive to assemble. Also, the prior art pump utilizes a relatively large number of separate parts, including two separate suction tubes, each attaching to a separate pump inlet and each having a separate filter. Prior art pumps, such as that depicted in FIG. 1, frequently require that vertically dropped ball check valves be press fitted into place, whereby the balls are pressed passed past a series of fingers or projections which retain the ball in its seated position.

Accordingly, a significant advance in the art could be realized if a solution to one or more of the prior art's drawbacks could be developed.

SUMMARY OF THE INVENTION

The present invention solves one or more of the aforementioned drawbacks of the prior art by incorporating several features which eliminate various components of prior art pumps, and provide new configurations which allow for faster assembly.

Two of the ball valves used in assembling the pump are capable of being vertically dropped into their respective chambers. In one preferred embodiment, the pump includes a flange for directing the vertically dropped ball valve into a valve chamber. The ball automatically seats itself, and is retained in the valve chamber by a piston spring.

In another embodiment of the invention, the pump includes a pair of cylinders communicating with a shared water inlet and a shared suction tube for drawing water from a water reservoir.

These and other advantages of the presently preferred embodiments will become more readily apparent as the following detailed description of the preferred embodiment proceeds, particularly with reference to the figures.

DETAILED DESCRIPTION OF THE PREFERRED EMBODIMENTS

Figure 2:
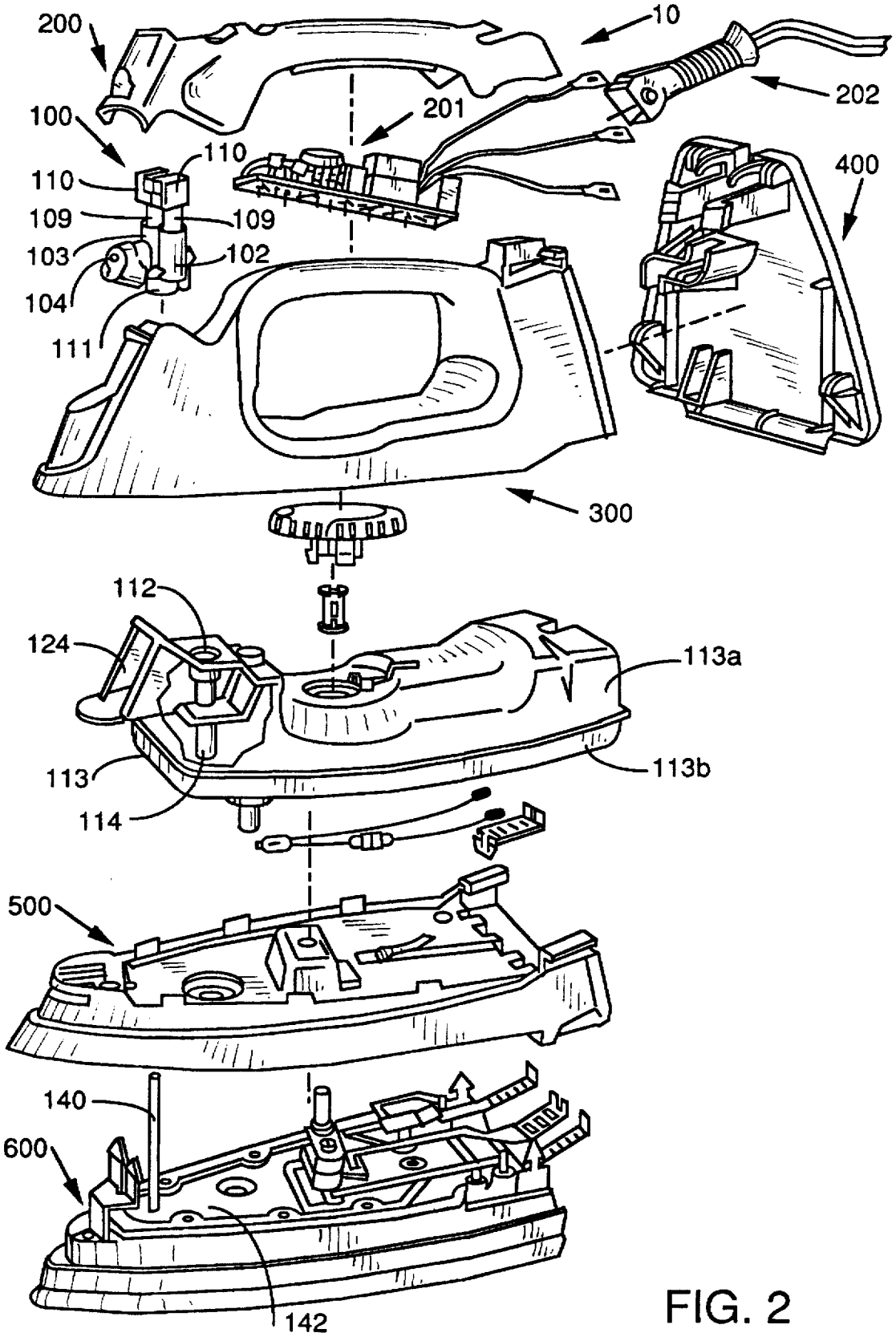
FIG. 2 is an exploded view of a preferred iron of the present invention.

Referring now to FIG. 2, there is illustrated an exploded view of a preferred iron, generally 10, of the present invention, comprising a pump assembly generally 100, housed within an upper housing comprising an upper handle generally 200, a lower handle and body, generally 300, and a heel plate generally 400. The iron further includes a water tank 113, described subsequently, which is positioned on a skirt portion, generally 500, which, in turn, sits atop a sole plate, generally 600. The iron also includes a circuit board generally 201, and a power cord assembly, generally 202. Except for the pump 100 and water tank 113 assemblies, described subsequently in greater detail, the remaining portions of the iron 10 illustrated in FIG. 2 may be conventional. Alternatively, various of these components may include features disclosed in pending applications filed by the present assignee concurrently herewith.

Figure 3:
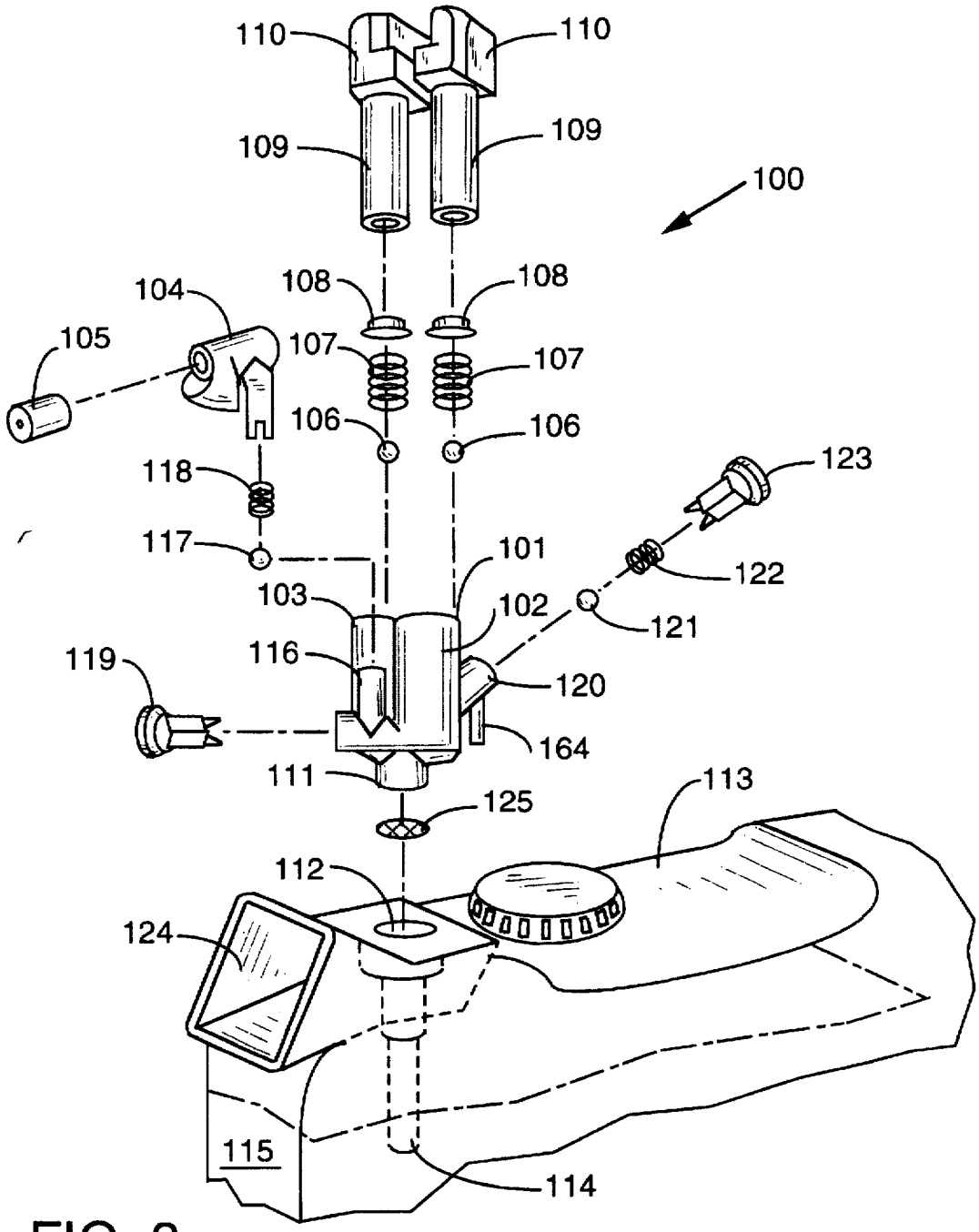
FIG. 3 is an exploded view of a preferred embodiment of the pump and water tank of the present invention.
Figure 4:
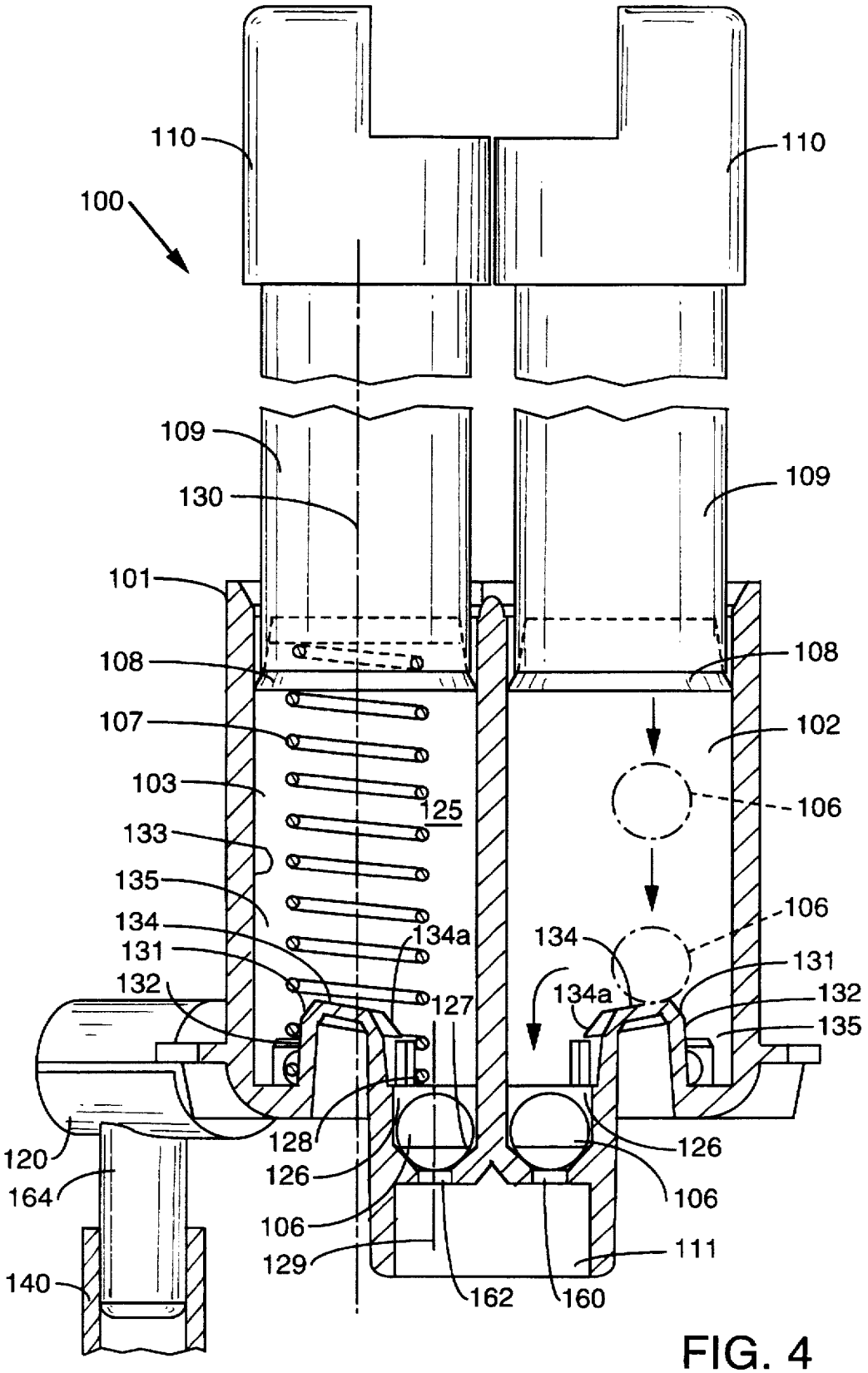
FIG. 4 is a partial cross-sectional view, as taken along lines 4—4 of FIG. 6, of the pump of FIG. 3, partially assembled.

Referring now to FIG. 3, the pump 100 of the present invention comprises a pump body or housing, 101, having a pair of pump cylinders 102 and 103. Pump cylinder 102 receives water through an inlet 111 for pumping through an outlet 116 to a nozzle 104 having a spreader 105 for producing a fine spray of water. The other pump cylinder 103 pumps water through an inlet 111 to an outlet 120 and to a steam chamber for producing a surge of steam as will subsequently be described. Referring to FIG. 4, each pump cylinder 102, 103 includes a ball check valve 106 at its inlet, 160, 162, respectively, a piston spring 107, and a piston seal 108 connected to a piston 109, which preferably includes a push button 110 designed to be pressed by the thumb of a user of the iron 10 for actuating pistons 109.

The pump housing 101 preferably includes a shared water inlet fitting 111 which communicates directly with both cylinder inlets 160, 162, and frictionally engages and seals with a receptacle 112 integrally molded into the water tank 113. The receptacle 112 preferably communicates with an integrally formed and shared suction tube 114 which draws water 115 into one of the two cylinders 102, 103 of the housing 101, depending upon which one of the two push buttons 110 is actuated. Preferably, both the receptacle 112 and suction tube 114 are integrally molded with the tank 113. This is advantageously accomplished by forming the tank 113 in two molded sections, 113*a* and 113*b*, which are fused together as illustrated in FIG. 2, with the upper portion 113*a* including the integrally molded receptacle 112 and suction tube 114. The molded sections of the tank, 113*a*, 113*b*, may be molded of any suitable injection molding material known to those of ordinary skill in the art, e.g., polyethylene, acetal, ABS, etc.

In addition to having a shared water inlet 111, the pump housing 101 includes a first water outlet 116 communicating via an outlet chamber 116*a* (FIG. 13) with the water spray cylinder 102 and the spray nozzle 104. A ball check valve 117 biased by a spring 118 allow the water outlet 116 to function as will subsequently be described in greater detail. A cap 119 closes off the end of the water outlet chamber 116*a*, illustrated in FIG. 13, formed during injection molding of the housing 101.

Figure 12:
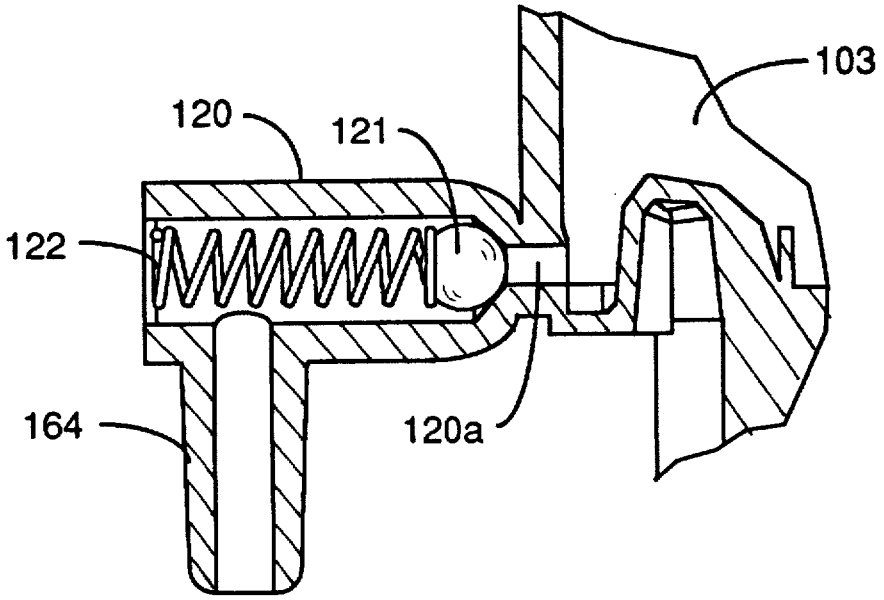
FIG. 12 is a partial cross-sectional view, taken along lines 12—12 of FIG. 6, of a portion of the pump housing assembly.

The other cylinder 103, used for providing a surge of steam, also includes a water outlet, 120, having a water outlet chamber 120*a*, which also has a ball check valve 121 biased by a spring 122 and retained by a cap 123, as best seen in FIGS. 3 and 12.

Figure 1:
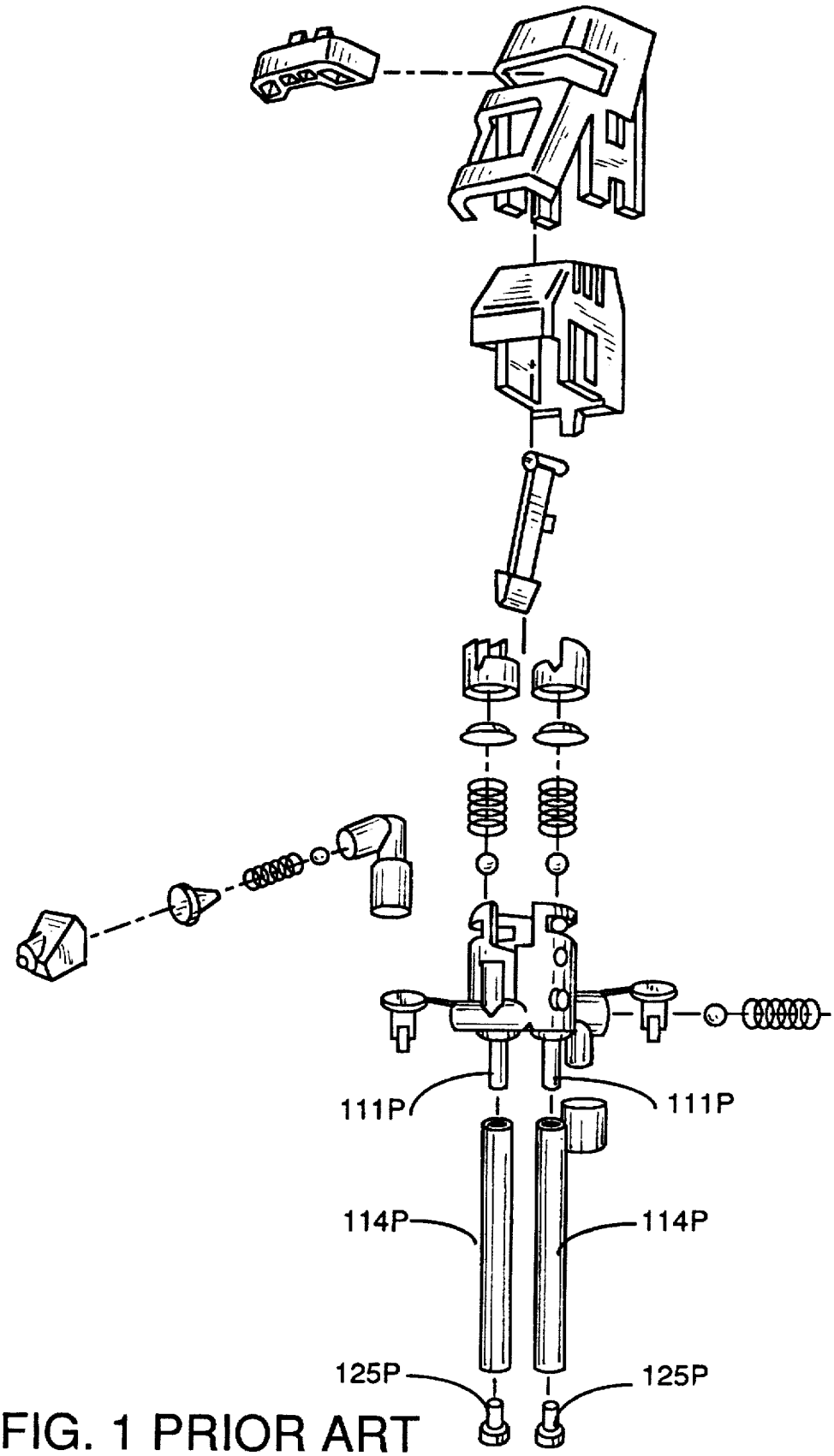
FIG. 1 PRIOR ART
FIG. 1 is an exploded view of a steam iron pump of the prior art.

The water tank 113 includes a water inlet 124 allowing the user to fill the tank 113 with water 115. The assembly also incorporates a filter, or screen 125 positioned in the receptacle 112 for filtering particulates from the water 115 prior to entering the pump housing 101. The screen 125 may be of any suitable type. In one preferred embodiment, the screen is 80×80 mesh, 304 stainless steel wire cloth, wire diameter 0.0055 inch (approximately 0.014 cm). As illustrated in FIG. 3, by seating the filter 125 in the water tank receptacle 112, only one filter is required for filtering particulates from water entering both cylinders 102, 103, in contrast to the requirement for two filters 125P of the prior art, illustrated in FIG. 1.

Referring now to FIG. 4, there is illustrated a partial cross-sectional view of a partially assembled pump 100 of the present invention. As will be readily understood, each of the pumping mechanisms for the respective cylinders 102 and 103 function substantially identically with respect to pumping water into the cylinder, and upon compression of the piston evacuating water through the cylinder's water outlet. Therefore, for purposes of simplicity and clarity, the present discussion will focus on only the operation of cylinder 103, it being understood and intended that the description shall apply with equal force to the cylinder 102.

As illustrated in FIG. 4, the cylinder 103 is adapted to slideably receive the pump piston 109. The piston 109 is biased at least partially externally with respect to the cylinder 103 by the piston spring 107, creating an enclosed volume 125 for evacuation of air and suction of water into the cylinder 103. When the steam piston button 110 is depressed such that the piston 109 and its piston seal 108 strokes downwardly into the cylinder 103, air is evacuated from the enclosed region 125 through the water outlet 120, the air pressure being sufficient to unseat the ball check valve 121, exiting through the water outlet chamber 120*a* and the outlet 120 (FIG. 12).

The pump housing 101 also includes a water inlet 111, which may be, but is not necessarily, shared by both cylinder 103 and the other cylinder 102. This water inlet 111 communicates, in the case of cylinder 103, with a cylinder inlet 162, which communicates with a valve chamber 126 having a valve seat 127 and a ball valve 106 for closing the water cylinder inlet 162 when the piston 109 is depressed in a downstroke operation. When the piston 109 is raised, for example, by releasing the button 110, the spring 107 forces the piston 109 upwardly, which, by suction, draws water into the cylinder enclosed region 125 through the inlet 111, through the cylinder inlet 162, and through the valve chamber 126, as the water pressure is sufficient to unseat the ball 106 from the valve seat 127.

Figure 5:
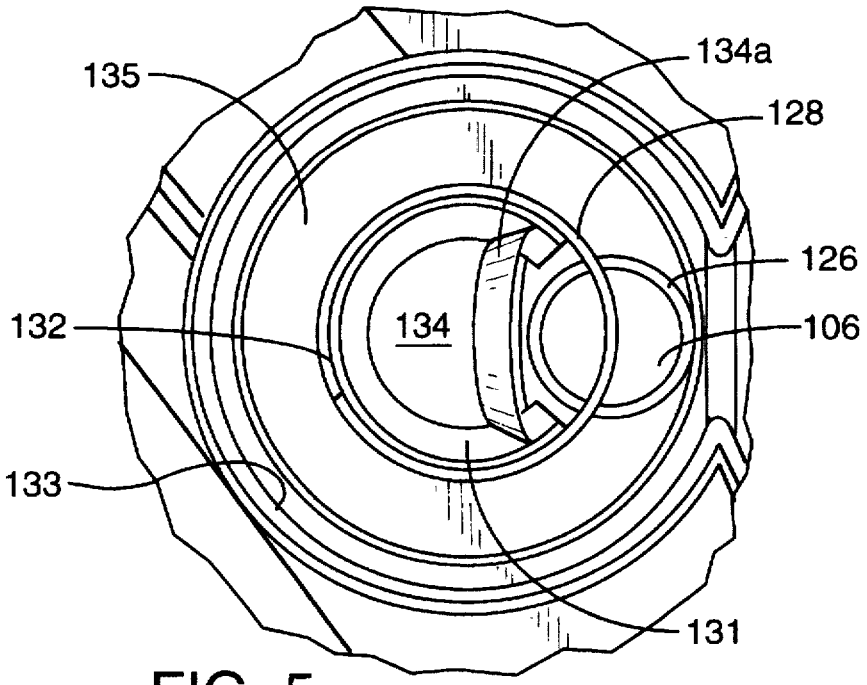
FIG. 5 is a top plan partial view of a preferred pump cylinder of the present invention.

In a highly preferred embodiment of the invention, the spring 107 retains the unseated ball valve 106 within the valve chamber 126 as the spring 107 bottom coil 128 passes substantially over the center of the valve chamber 126 and the ball 106 as best seen in FIG. 5.

Returning to FIG. 4, the valve chamber 126 has an axial centerline 129, as does the cylinder 103 at 130. As seen in FIG. 4, the axial centerline 129 is offset with respect to the cylinder centerline 130. This offset allows the lower—most coil 128 of the spring 107 to retain the ball 106 in the valve chamber 126, as previously discussed. Of course, it would also be possible to center the valve chamber 126 directly on the centerline 130 and still retain the ball 106 with the spring 107, particularly if the last coil of the spring 107 included a bent end which bisected the spring and the ball 106.

As also illustrated in FIG. 4, the cylinder 103 includes an upwardly disposed flange 131 having an outer wall 132 facing the inner wall 133 of the cylinder 103. The flange 131 helps retain the spring 107 in place during assembly, the outside diameter of the flange 131 being the same or slightly greater than the inside diameter of the spring, 107, allowing a friction fit between them.

As illustrated in phantom lines and arrows in cylinder 102 of FIG. 4, when a ball valve 106 is dropped into the cylinder 102, 103 during assembly, it hits the upwardly disposed flange 131 and rolls into the valve chamber 126. In one preferred embodiment, this is accomplished by having an upwardly disposed flange 131 having a downwardly sloping upper surface 134, which, in the embodiment of FIG. 4, is a generally planar inclined surface. Alternatively, the surface 134 could be curvilinear, for example either generally concave or convex or a combination thereof, or a combination planar/curvilinear surface.

The space 135 between the inner wall 133 of the cylinder 103 and the outer wall 132 of the flange 131 is preferably large enough to allow the spring 107 to pass between the inner wall 133 of the cylinder and the outer wall 132 of the flange 131. The space 135 is not, however, large enough to allow the ball 106 to become hung up within the space, rather the ball 106 rolls along the space/flange like a track, or bounces down the surface 134 into the valve chamber 126.

Figure 6:
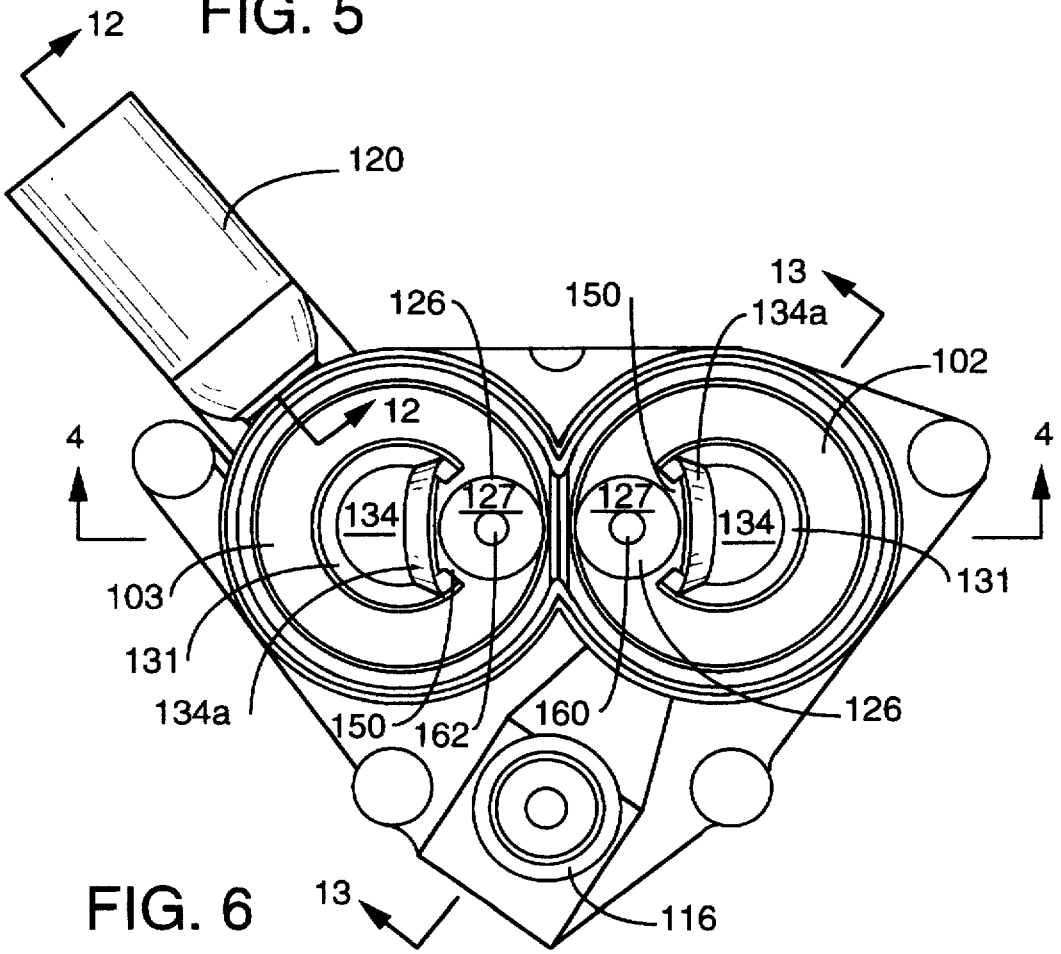
FIG. 6 is a top plan view of the pump of FIG. 3 with the springs and pistons removed.
Figure 7:
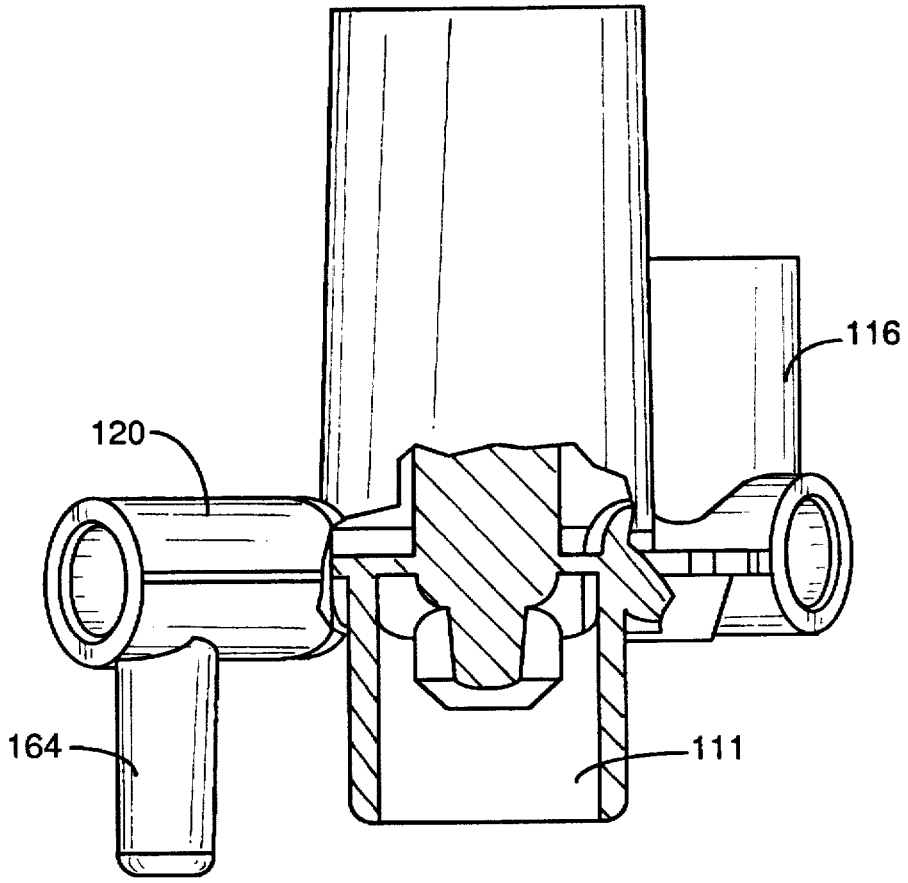
FIG. 7 is an elevational view, partially broken away along lines 7—7 of FIG. 8, of a preferred pump housing of the present invention.
Figure 8:
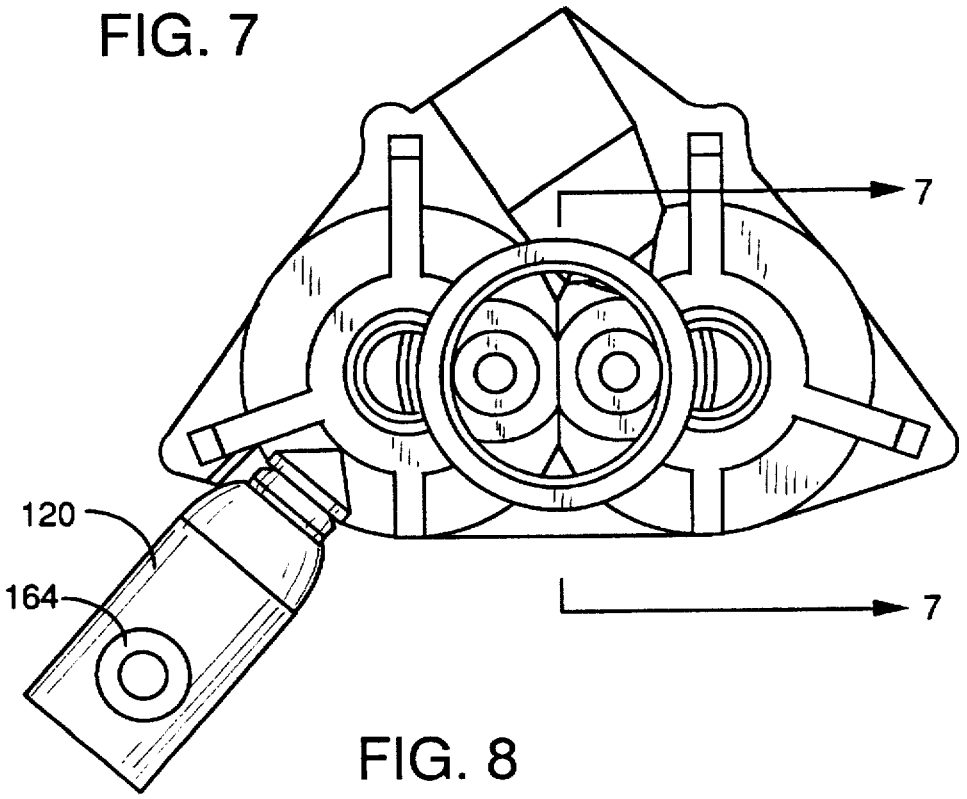
FIG. 8 is a bottom plan view of the pump housing of FIG. 6.
Figure 9:
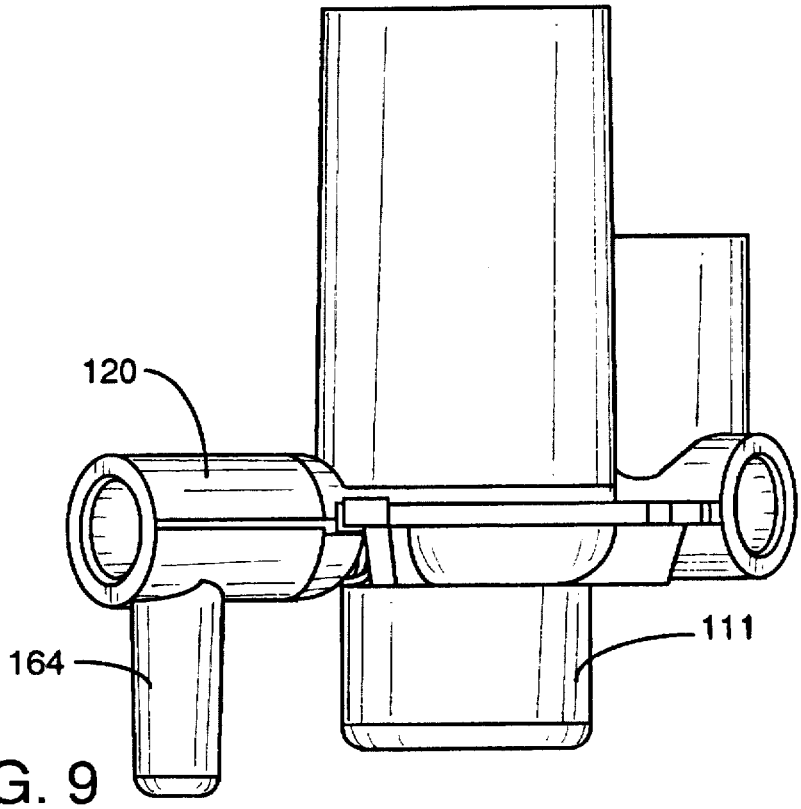
FIG. 9 is a side elevational view of the pump housing of FIG. 6.
Figure 10:
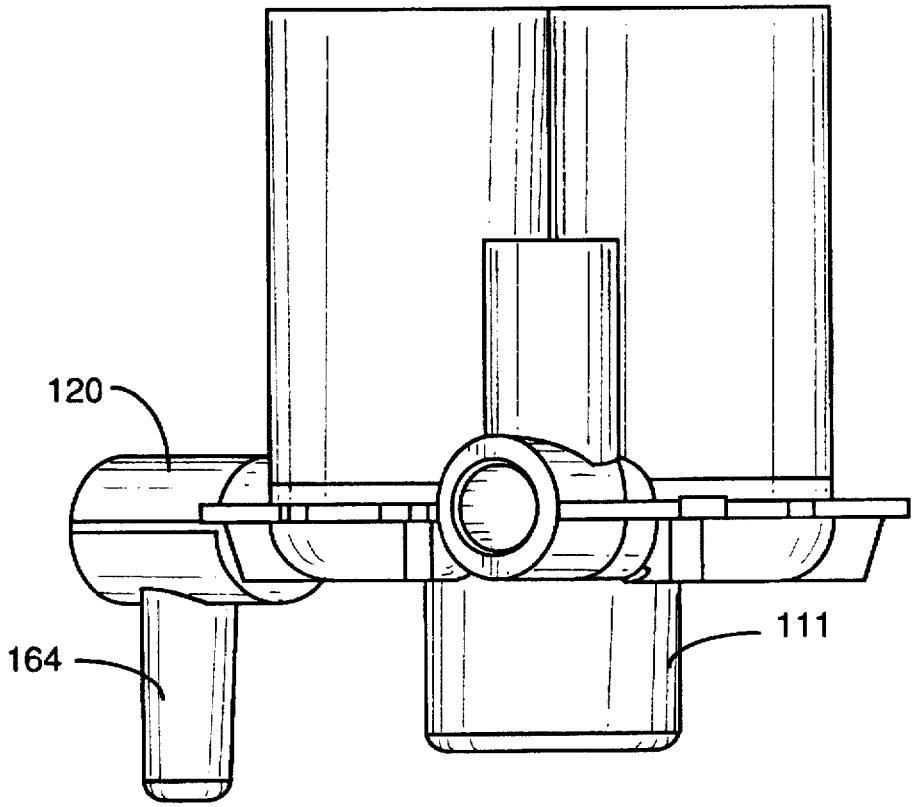
FIG. 10 is a view of the pump housing of FIG. 9 rotated 90°.
Figure 11:
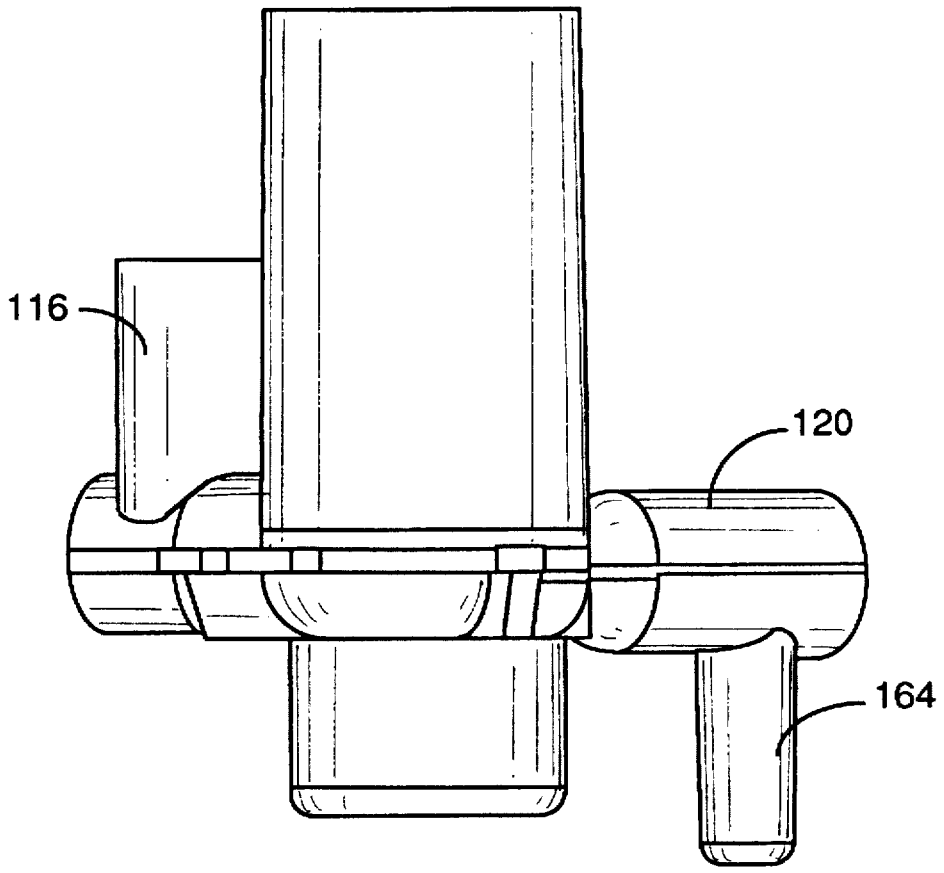
FIG. 11 is an elevational view of the pump housing of FIG. 9 rotated 180°.

As illustrated, especially in FIG. 4, the flange 131 may include a more steeply inclined surface 134*a* with respect to the surface 134, for further assisting directing the ball 106 into a seated position. As best seen in FIG. 6, this surface 134*a* may, in one preferred embodiment, define a cutout region 150 of the otherwise circular flange 131. The cutout region allows clearance for the ball 106 to drop past the flange 131 into the valve chamber 126.

In a highly preferred embodiment of the invention, both of the cylinders 102, 103 communicate with a shared water inlet 111 in the housing 101. By making use of a shared water inlet 111, a number of components can be eliminated, such as duplicate water inlets 111P, suction tubes 114P, and filters 125P, seen in FIG. 1.

The shared water inlet 111 will direct water into either of the two cylinders 102, 103, depending upon which button 110 and its associated piston 109 is depressed. Once the piston 109 is depressed, air evacuated from the cylinder, and water drawn into the cylinder through suction, the relative pressures on either side of the check valve 106 approximately equal and the check valve 106 again seats itself. At this point, water is retained within the cylinder and ready to be ejected by the next downstroke of the piston 109. Upon such downstroke, the piston 109 and its piston seal 108 forces the water out of the cylinder through its outlet, such as the outlet 120.

In the case of the surge of steam cylinder 103, water is ejected from the water outlet 120 through a fitting 164 to which is connected a tube 140. Water is forced via the tube 140 down into a steam chest 142 as illustrated in FIG. 2. Once the water hits the hot surfaces of the steam chest 142, the steam surge is produced. The pressure of the water being forced through the outlet 120 is sufficient to unseat the ball valve 121 and deflect the spring 122 which biases the ball valve 121 against its valve seat as illustrated in FIG. 12. Once the water is all ejected from the cylinder 103 the pumping cycle is ready to repeat itself as previously described.

Figure 13:
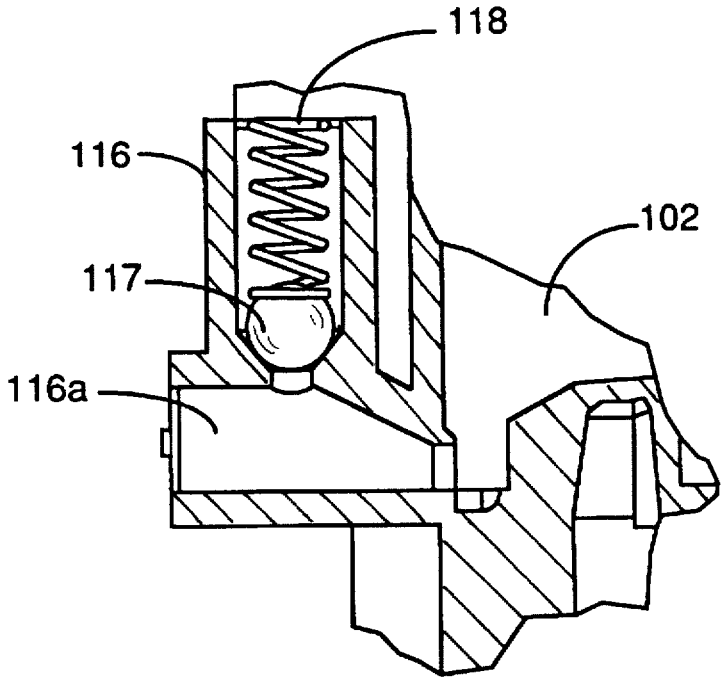
FIG. 13 is another partial cross-sectional view, taken along lines 13—13 of FIG. 6, of another portion of the pump housing assembly.

In the case of the water spray operation, the pump piston 9 associated with cylinder 102 is depressed, forcing air out of the cylinder 102 through the cylinder outlet 116, unseating the check ball valve 117 through deflection of its biasing spring 118, best seen in FIG. 13. This spring 118 and ball valve 117 are held in position by the spray nozzle 104, illustrated in FIG. 3. As water is drawn into the cylinder 102 upon release of the button 110, causing the spring 107 to push the piston 109 out of the cylinder 102, the check valve 117 seats itself, increasing the efficiency of water suction into the cylinder 102. On the next downstroke of the piston 109 into the cylinder 102, water is forced out of the cylinder 102 into the water outlet chamber **116*a*, unseating the ball valve 117, allowing the water to flow out the outlet 116 through the nozzle 104**.

The housing 101 may optionally be configured to provide for only water spray or only steam surge, and single button operation, for example, by sealing the appropriate inlet/outlet ports, allowing the same pump housing of the present invention to be used for different iron models.

In order to improve pumping efficiency, the internal surfaces of the pump housing 101 and the external fittings thereof are preferably of high gloss and substantially free of surface imperfections and insert lines. The pump components are preferably fabricated of injection molded plastics of the type known to those of ordinary skill in the art, such as acetal, ABS, etc., with the exception of the springs, balls, and screen, which may be metal, e.g., stainless steel, and the piston seals, which are preferably a resilient polymeric material known to those of ordinary skill in the art, such as neoprene, or other synthetic or natural rubber. The ball valves may also be plastic rather than metal.

The invention in its broader aspects is not limited to the specific details of the preferred embodiments shown and described, and those of ordinary skill in the art will recognize that the invention can be practiced with modifications within the spirit and scope of the appended claims, including any and all equivalents thereof. Additionally, although certain preferred embodiments of the invention described herein satisfy one or more objects and provide one or more advantages as discussed above, it is expressly contemplated that the invention may be practiced in spirit without utilizing all of the objects and advantages taught herein, and that accordingly, the objects and advantages of the invention form no part thereof, except as such may be embodied by the full scope of the following claims.

We claim:

1. A pump for pumping water from a water reservoir in a steam iron for use during ironing, said pump comprising:

a. a pump housing including at least one cylinder for receiving a pump piston; said cylinder having an inner wall and an axial center line;

b. a pump piston slideably received in said cylinder and biased at least partially externally with respect to said cylinder by a piston spring;

c. said pump housing including a water inlet communicating with a valve chamber having a valve seat and ball valve for closing said water inlet when said pump piston is depressed, and opening said water inlet when said pump piston is raised;

d. said valve chamber having an axial centerline, said valve chamber axial centerline being offset with respect to said cylinder axial centerline;

e. said cylinder having an upwardly disposed flange for directing said ball valve into said valve chamber when said ball valve is dropped vertically into said cylinder during assembly of said pump.

2. The pump of claim 1 wherein said upwardly disposed flange has a downwardly disposed surface for directing said ball valve into said valve chamber during assembly of said pump.

3. The pump of claim 1 wherein a portion of said piston spring retains said ball valve in said valve chamber.

4. The pump of claim 2 wherein said downwardly disposed surface is inclined.

5. The pump of claim 2 wherein said downwardly disposed surface is curvilinear.

6. The pump of claim 1, wherein said piston spring is retained in said cylinder by said upwardly disposed flange.

7. A pump for pumping water from a water reservoir in a steam iron for use during ironing, said pump comprising:

a. a pump housing having two cylinders, one said cylinder for pumping water to a spray nozzle, the other said cylinder for pumping water to a source of heat in said iron for generating steam;

b. each said cylinder including an upwardly disposed flange for directing a ball valve into a valve seat in a base of each said cylinder;

c. each said cylinder having slideably disposed therein a piston, each said piston including a push button for actuating said piston;

d. each said piston being biased apart from the base of said cylinders by a piston spring;

e. said cylinders communicating with a shared water inlet in said housing.

8. A pump for pumping water from a water reservoir in a steam iron for use during ironing, said pump comprising:

a. a pump housing having two cylinders, one said cylinder for pumping water to a spray nozzle, the other said cylinder for pumping water to a source of heat in said iron for generating steam, said cylinders having an axial centerline therebetween, each cylinder having slideably disposed therein a piston, each said piston including a push button for actuating said piston;

b. each said piston being biased apart from the base of said cylinders by a piston spring; and c. said cylinders communicating with a shared water inlet in said housing, said water inlet extending to the water reservoir along said axial centerline between said cylinders.

* * * * *